US005361437A

United States Patent [19]

Zhu et al.

[11] Patent Number: 5,361,437

[45] Date of Patent: Nov. 8, 1994

[54] MASSAGE CUSHION FOR PROVIDING A HAMMERING MODE MASSAGE

[75] Inventors: Li S. Zhu; Wei He; Yu C. Huang; Wan S. Guo, all of Shanghai, China

[73] Assignee: Shanghai Intor Electrical Applicance Factory, Shanghai, China

[21] Appl. No.: 991,159

[22] Filed: Dec. 16, 1992

[30] Foreign Application Priority Data

Dec. 19, 1991 [CN] China ..... 91231059.6

[51] Int. Cl.[5] ..... A47C 20/02

[52] U.S. Cl. ..... 5/639; 5/915; 601/49; 601/78

[58] Field of Search ..... 5/639, 645, 915; 128/33, 42, 43; 601/49, 51, 78

[56] References Cited

U.S. PATENT DOCUMENTS

| | | | |
|---|---|---|---|
| 2,304,485 | 12/1942 | Spencer et al. | 128/33 |
| 2,786,465 | 3/1957 | Moxley | 5/915 X |
| 2,840,071 | 6/1958 | McNair | 128/33 |
| 2,921,578 | 1/1960 | Rabhan | 128/33 |
| 2,943,620 | 7/1960 | Sibert | 128/33 |
| 2,943,621 | 7/1960 | Phillips et al. | 5/915 |
| 3,457,911 | 7/1969 | Carpenter | 128/33 |
| 3,854,474 | 12/1974 | Carruth | 128/33 |
| 4,105,024 | 8/1978 | Raffel | 5/915 X |
| 4,136,685 | 1/1979 | Ramey | 5/915 X |
| 5,092,316 | 3/1992 | Taylor et al. | 128/33 X |

FOREIGN PATENT DOCUMENTS

| | | |
|---|---|---|
| 87211158 U | 10/1988 | China . |
| 89201987.5 | 8/1989 | China . |
| 89217868.X | 8/1990 | China . |
| 90200980.X | 11/1990 | China . |

*Primary Examiner*—Michael J. Milano

*Attorney, Agent, or Firm*—Merchant, Gould, Smith, Edell, Welter & Schmidt

[57] ABSTRACT

A soft cushion having a mechanism mounted therein for imparting electromagnetic hammering mode massage to its user, the device including an electromagnetic hammering mechanism, a clamping plate frame, and an electric control unit. The device is portable and may be used either as a soft cushion or as a hammering mode massage unit in which selection of the massage frequency, intensity and massage status is possible. The device may be held by hand, or put on a sofa, chair, bed, or car seat.

3 Claims, 2 Drawing Sheets

MASSAGE CUSHION FOR PROVIDING A HAMMERING MODE MASSAGE

BACKGROUND OF THE INVENTION

The present invention relates to a soft cushion which not only can be used as a back cushion for leaning on but also includes a mechanism for providing a user with a massage in Chinese traditional manual hammering mode.

The Chinese traditional massage using the manual hammering mode is useful for relief of fatigue and is beneficial for maintaining health. However, it is labour-consuming, and many people resort to using other massage methods. The electrical hammering mode massage sofa (Chinese Patent Application No. 87211158) is equipped with a massage unit installed in a sofa. It is, however, not portable and the position the user and the location on the body requiring of massage cannot be selected at will. In addition, the massage unit consists of a cam fixed on a long driving shaft and a hammering device installed in a supporting frame with holes. The massage generated by this device is performed stiffly and is not comfortable. Furthermore, the device is complicated in construction and heavy.

The present invention solves these and other problems associated with electrical hammering mode massage devices.

SUMMARY OF THE INVENTION

The purpose of the invention is to offer a soft cushion which includes a mechanism for providing a user with a hammering mode massage which is small in size and light-weight. When a massage is desired, the device can be either held by hand, or put on a sofa, chair, bed or car seat.

The purpose of the invention is realized as follows: the hammering mode massage soft cushion comprises an electromagnetic hammering mode massage device covered by sponge, an internal lining covering the sponge, and an external cover. The electromagnetic hammering mode massage device comprises an electromagnetic hammering mechanism, a clamping plate frame for installation of the electromagnetic hammering mechanism, and a control unit installed within the soft cushion for user control of the massage speed, intensity and electromagnetic hammering. The massage intensity, speed, and status can be adjusted according to the user's requirements so as to relax muscles, speed up localized blood circulation, relieve fatigue and lessen pain. It acts as a supplementary physio-therapy to maintain the health of a human body.

In the following, the preferred embodiment of the present invention will be described in detail with reference to the accompanying drawings.

BRIEF DESCRIPTION OF THE DRAWINGS

Referring now to the Figures in which like reference numerals represent corresponding parts throughout the several views.

DETAILED DESCRIPTION OF THE INVENTION

Figure 1:
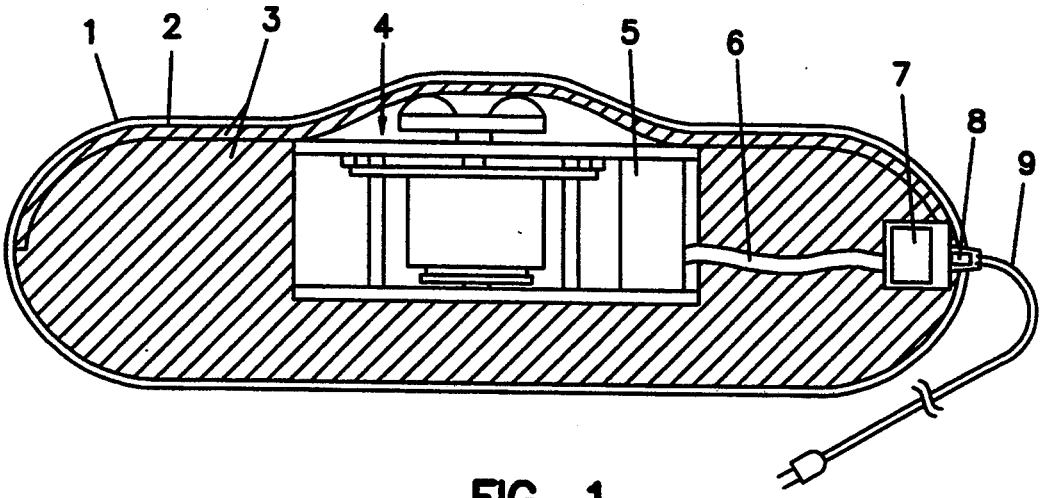
Fig. 1 is a side sectional view showing the preferred embodiment according to the present invention.
Figure 2:
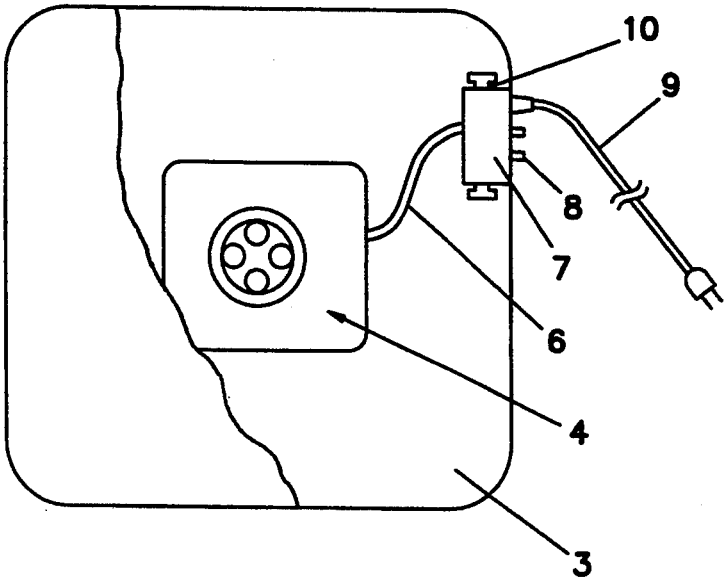
Fig. 2 is a partial sectional top plan view of the preferred embodiment as shown in FIG. 1.

With reference to FIG. 1 and FIG. 2, the schematic drawings show a preferred embodiment of the invention which includes:

an external cover (1) with an internal lining (2), an elastic filler, such as a sponge (3), enveloped by the internal lining (2);

an electromagnetic hammering mode massage device (4) installed centrally within the elastic filler of sponge (3), including:

an electronic circuit box (5), connected via a conductor (6) to a control box (7), installed in a clamping plate frame of the electromagnetic hammering mode massage device, the Control box (7) is fitted with a power supply socket fixed to a side of the cushion by a securing ring (10) (see FIG. 2). A potentiometer (8) is provided to perform and adjust the hammering mode massage.

Figure 3:
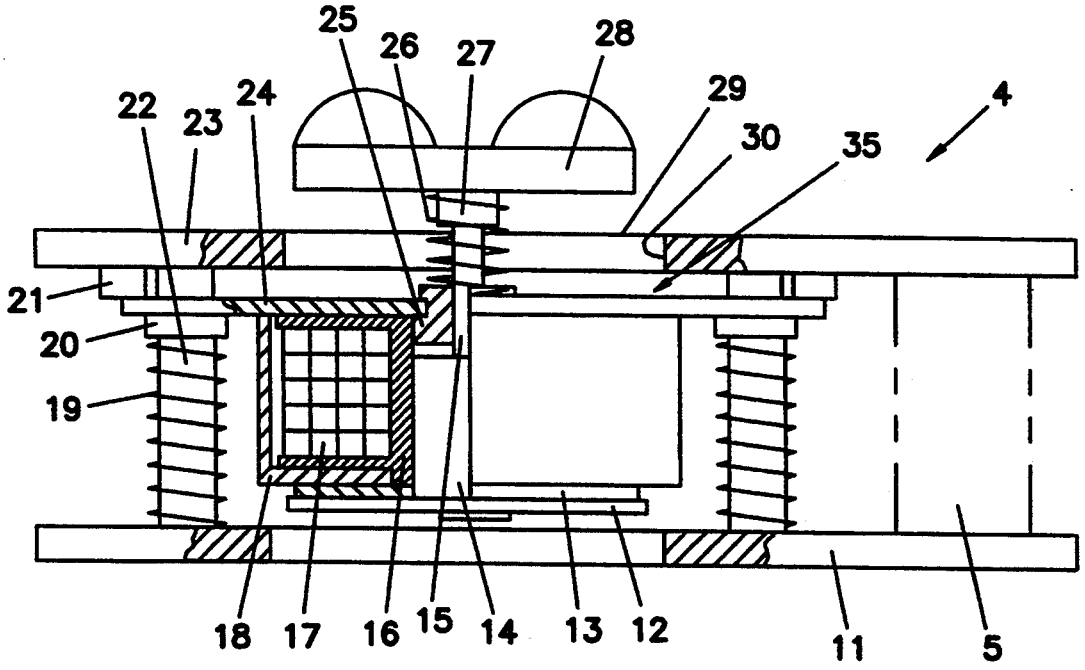
FIG. 3 is a partial sectional view of the electromagnetic hammering mode massage device shown in FIG. 1.

As shown in FIG. 3, the electromagnetic hammering mode massage device (4) comprises an electromagnetic hammering mechanism (35), a clamping plate frame (29), and an electric control unit including a circuit box (5). The electromagnetic hammering mechanism (35) of the preferred embodiment is situated centrally within the clamping frame (29).

The clamping plate frame (29) includes a rear plate (11) and a front plate (23) with four supporting columns (22) of equal length are mounted there between so that the front plate (23) and the rear plate (11) are spaced parallel to each other. On both the rear plate (11) and the front plate (23), holes are provided for mounting the ends of the supporting columns thereto. The four supporting columns (22) are distributed evenly around a hole (30) formed in the front plate (23). A shock-absorbing block (21) is fixed to a rear surface of the front plate (23) around the hole (30) of the front plate (23).

The electromagnetic hammering mechanism (35) includes a stop block (25), having a centrally-located through hole formed therein, which is mounted in a through hole formed in the center of a stop plate (24). A coil frame (16), wound to form a coil (17) and mounted in a magnet yoke (18), has a cylindrical through hole formed in the center of the coil frame (16). An end of the stop block (25) which protrudes through the stop plate (24) is fitted within one end of the coil frame through hole. The magnet yoke (18) is fastened to the stop plate (24) so that the coil frame (16) is also fixed on the stop plate (24). The magnet yoke (18) is also provided with a through hole which aligns with the center through hole of the coil frame (16). A cylindrical armature (14) is fastened at a lower end to a stop ring (12). An upper end of the armature (14) passes through the through hole of the magnet yoke (18) into the center through hole of the coil frame (16). The upper end of the armature (14) is provided with a threaded hole. A shock-absorbing gasket (13) is installed between the top surface of the stop ring (12) and the bottom face of the magnet yoke (18). A sliding rod (15), which has a threaded lower end, is slideably disposed in the through hole of the stop block (25). The threaded end of the sliding rod (15) is engaged with the threaded hole in the upper end of the armature (14). A hammering head (28) is attached to the upper end of the sliding rod (15). A shock absorber structure consisting of a compressible spring (26) and a shock absorbing ring (27) is mounted on the sliding rod (15) between the top face of the stop block (25) and the bottom face of the hammering head (28). The stop plate (24) is provided with guide holes which align with the columns (22) which allow the stop plate (24) to slide along the columns (22). A flange (20) is disposed in alignment with and immediately under each guide hole of the stop plate (24). A compressible spring (19) is fitted around each supporting column (22) between a lower end face of the flange (20) and the top surface of the rear plate (11) so that the whole electromagnetic hammering mechanism (35) can be elastically installed in the clamping plate frame. After installation of the electromagnetic hammering mechanism in the clamping plate frame, the hammering head (28) should protrude from the top surface of the front plate (23) through hole (30).

Figure 4:
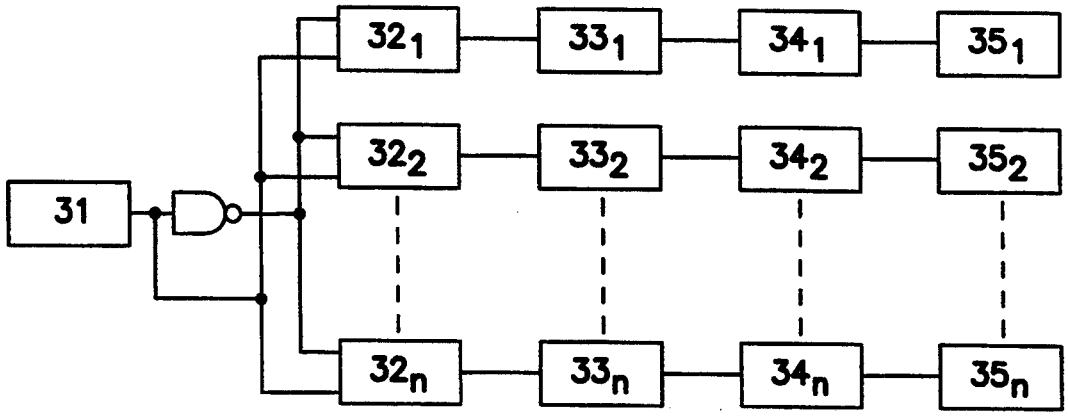
FIG. 4 is a block diagram of the circuit for the electromagnetic hammering mode massage device shown in FIG. 1.

FIG. 4 shows a block diagram of an electric control unit of the present invention which includes a pulse shaping circuit (31), a massage status controlling circuit (32), a pulse-width regulating circuit (33), and an electronic switch (34). The beat output of the pulse-shaping circuit (31) regulates the hammering speed; the massage status controlling circuit (32) is brought into operation through the selection switch following the pulse-shaping. Hammering intensity is regulated by changing the pulse width with the pulse-width adjustment circuit (33). The pulse current output from the electronic switch (34) is transmitted to the magnet coil (17) of the electromagnetic hammering mechanism (35) so as to produce an electromagnetic force for driving the hammering head (28) resulting in the hammering mode massage action. Though the preferred embodiment employs only one electromagnetic hammering mechanism, FIG. 4 shows the circuit black diagram for a plurality of electromagnetic hammering mechanisms represented in the block diagram by reference numbers having a subscript 1—n.

The electronic circuit of the present invention is designed to use either alternating or direct current power supply with a voltage of 12V–220V. It can also incorporate an isolation transformer or a safety device against electric shock. Additionally, the device may be provided with a protection function to stop operation upon absence of the person using the device, or an automatic shut-off function activated by temperature control. The device may also be equipped with an audio device for music or a radio set.

It is to be understood that the outward appearance of the soft cushion of the present invention, the surface material used for external cover (1) and the filling material may be selected to meet various requirements. Furthermore, changes may be made in details of the other components within the principles of the invention to the full extent indicated by the broad general meaning of the terms in which the appended claims are expressed. For instance, more than one hammering mode massage mechanism may be installed within the soft cushion.

We claim:

1. A massage cushion for providing hammering mode massage comprising:

an electromagnetic hammering massage device and a layer of padding enveloping said electromagnetic hammering massage device, said electromagnetic hammering massage device includes:

an electromagnetic hammering mechanism including a hammering head and means for reciprocally moving said hammering head relative to said electromagnetic hammering mechanism;

an electric control unit installed in the cushion for controlling said electromagnetic hammering mechanism; and a clamping plate frame supporting said electromagnetic hammering mechanism, said clamping plate frame includes:

a rear plate having a hole centrally formed therein, four columns symmetrically distributed around the hole of said rear plate, an end of each column fixed on said rear plate, a front plate having a hole centrally formed therein, a free end of each of said four columns fixed to said front plate, said electromagnetic hammering mechanism slideably mounted on said columns to allow reciprocal movement within said frame, and a shock absorbing block fixed to a bottom surface of the front plate and around the hole in said front plate.

2. A massage cushion for providing hammering mode massage according to claim 1, wherein said electromagnetic hammering mechanism includes:

a stop plate with a center through hole and four guide holes for slideably receiving said columns of said clamping plate frame, a stop block mounted in the center through hole of said stop plate and having a through hole, a coil frame supporting a magnetic coil said coil frame having a cylindrical through hole within an end of which is mounted an end of the stop block, a magnet yoke fitted over the coil frame and fixed to a bottom surface of said stop plate, an armature slideably disposed within said coil frame through hole, a stop ring located under said magnet yoke, one end of said armature being fastened to said stop ring, a shock absorbing gasket mounted to said stop ring between said stop ring and said magnet yoke, a sliding rod slideably disposed in the through hole of said stop block; one end of said sliding rod is fixed to a free end of said armature and another end of said sliding rod is fixedly connected to the hammering head, a shock absorbing unit consisting of a compressible spring and a shock absorbing ring fitted over the sliding rod between the stop block and the hammering head;

a compressible spring fitted over each of said columns between a lower surface of the stop plate and an upper surface of said rear plate such that said electromagnetic hammering mechanism is elastically installed in the clamping plate frame; and after installation of the electromagnetic hammering mechanism in said clamping plate frame, said hammering head protrudes from an upper surface of said front plate.

3. A massage cushion for providing hammering mode massage according to claim 2, wherein the electromagnetic hammering mechanism is put in the middle of said clamping plate frame.

* * * * *

UNITED STATES PATENT AND TRADEMARK OFFICE

CERTIFICATE OF CORRECTION

PATENT NO. : 5,361,437

DATED : November 8, 1994

INVENTOR(S) : Zhu Li Shan et al.

It is certified that error appears in the above-identified patent and that said Letters Patent is hereby corrected as shown below:

On title page, under item [73] "Assignee," the word "Applicance" should read --Appliance--.

Signed and Sealed this

Twenty-seventh Day of February, 1996

*Attest:*

*Attesting Officer*

BRUCE LEHMAN

*Commissioner of Patents and Trademarks*